US008932149B2

(12) United States Patent
Oldknow

(10) Patent No.: US 8,932,149 B2
(45) Date of Patent: Jan. 13, 2015

(54) GOLF CLUB ASSEMBLY AND GOLF CLUB WITH AERODYNAMIC FEATURES

(75) Inventor: Andrew G. V. Oldknow, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 295 days.

(21) Appl. No.: 13/485,280

(22) Filed: May 31, 2012

(65) Prior Publication Data

US 2013/0324295 A1 Dec. 5, 2013

(51) Int. Cl.
*A63B 53/04* (2006.01)
*A63B 49/06* (2006.01)

(52) U.S. Cl.
CPC ..... *A63B 53/0466* (2013.01); *A63B 49/06* (2013.01); *A63B 2225/01* (2013.01); *A63B 2053/0412* (2013.01); *A63B 2053/0408* (2013.01); *A63B 2053/0437* (2013.01)
USPC ..... 473/327; 473/328; 473/345

(58) Field of Classification Search
USPC ..... 473/324–350, 287–292
See application file for complete search history.

(56) References Cited

U.S. PATENT DOCUMENTS

| | | | | |
|---|---|---|---|---|
| 1,587,758 | A | 6/1926 | Charavay | |
| 4,444,392 | A | 4/1984 | Duclos | |
| D275,412 | S | 9/1984 | Simmons | |
| 4,653,756 | A | 3/1987 | Sato | |
| 4,754,974 | A * | 7/1988 | Kobayashi | 473/327 |
| 4,850,593 | A | 7/1989 | Nelson | |
| D307,783 | S | 5/1990 | Iinuma | |
| 4,951,953 | A * | 8/1990 | Kim | 473/320 |
| 5,054,784 | A | 10/1991 | Collins | |
| D326,885 | S * | 6/1992 | Paul | D21/733 |
| 5,120,061 | A | 6/1992 | Tsuchida et al. | |
| 5,158,296 | A | 10/1992 | Lee | |
| 5,190,289 | A | 3/1993 | Nagai et al. | |
| 5,193,810 | A | 3/1993 | Antonious | |
| 5,203,565 | A | 4/1993 | Murray et al. | |
| 5,221,086 | A | 6/1993 | Antonious | |
| 5,240,252 | A | 8/1993 | Schmidt et al. | |
| 5,271,622 | A | 12/1993 | Rogerson | |
| D345,403 | S * | 3/1994 | Sanchez | D21/752 |

(Continued)

FOREIGN PATENT DOCUMENTS

| | | | |
|---|---|---|---|
| JP | 2009000281 | A | 1/2009 |
| WO | 2010028114 | A2 | 3/2010 |
| WO | 2010104898 | A2 | 9/2010 |

OTHER PUBLICATIONS

ADAMSGOLF, Speedline Driver advertisement, Golf World magazine, Mar. 9, 2009, p. 15.

*Primary Examiner* — Sebastiano Passaniti
(74) *Attorney, Agent, or Firm* — Banner & Witcoff, Ltd.

(57) ABSTRACT

A golf club includes a shaft and a club head. The club head may have a channel extending adjacent to a trailing edge of the club head. The channel may have a maximum depth of 6 mm and a maximum width ranging from 10 mm to 20 mm. A rough textured surface region may be provided on a sole, wherein the rough textured surface region has a surface roughness of greater than or equal to 1.00 μm. A recess, formed in the sole, may extend from a mid-region to a toe of the club head, wherein the mid-region extends over the middle 40% of a length of the club head. A crown has an upper, forward surface and a stepped-down region, and the upper, forward surface transitions to the stepped-down region at a transition feature that extends from the hosel region at an angle of from 25 to 50 degrees.

15 Claims, 5 Drawing Sheets

(56) References Cited

U.S. PATENT DOCUMENTS

| | | | | | |
|---|---|---|---|---|---|
| 5,318,297 | A | | 6/1994 | Davis et al. | |
| D349,934 | S | * | 8/1994 | Feche et al. | D21/733 |
| D350,580 | S | * | 9/1994 | Allen | D21/733 |
| 5,435,558 | A | | 7/1995 | Iriarte | |
| 5,465,970 | A | | 11/1995 | Adams et al. | |
| 5,505,448 | A | | 4/1996 | Park | |
| 5,511,786 | A | | 4/1996 | Antonious | |
| 5,524,890 | A | | 6/1996 | Kim et al. | |
| D371,407 | S | * | 7/1996 | Ritchie et al. | D21/733 |
| 5,544,884 | A | | 8/1996 | Hardman | |
| 5,575,725 | A | | 11/1996 | Olsavsky | |
| 5,643,107 | A | | 7/1997 | Gorman | |
| 5,681,227 | A | | 10/1997 | Sayrizi | |
| 5,700,208 | A | * | 12/1997 | Nelms | 473/324 |
| 5,735,754 | A | | 4/1998 | Antonious | |
| 5,785,609 | A | | 7/1998 | Sheets et al. | |
| D398,681 | S | | 9/1998 | Galy | |
| 5,803,830 | A | | 9/1998 | Austin et al. | |
| 5,873,793 | A | | 2/1999 | Swinford | |
| 5,913,733 | A | | 6/1999 | Bamber | |
| 5,921,870 | A | | 7/1999 | Chiasson | |
| 5,954,595 | A | | 9/1999 | Antonious | |
| 5,961,397 | A | | 10/1999 | Lu et al. | |
| 5,980,394 | A | | 11/1999 | Domas | |
| 5,997,413 | A | | 12/1999 | Wood, IV | |
| 5,997,415 | A | | 12/1999 | Wood | |
| 6,017,280 | A | | 1/2000 | Hubert | |
| 6,027,414 | A | | 2/2000 | Koebler | |
| D421,472 | S | | 3/2000 | Peterson | |
| 6,059,669 | A | | 5/2000 | Pearce | |
| 6,074,308 | A | | 6/2000 | Domas | |
| 6,319,148 | B1 | | 11/2001 | Tom | |
| D470,202 | S | | 2/2003 | Tunno | |
| 6,530,847 | B1 | | 3/2003 | Antonious | |
| 6,561,922 | B2 | | 5/2003 | Bamber | |
| 6,609,981 | B2 | | 8/2003 | Hirata | |
| D481,430 | S | | 10/2003 | Tunno | |
| 6,773,359 | B1 | | 8/2004 | Lee | |
| 6,776,725 | B1 | * | 8/2004 | Miura et al. | 473/327 |
| 6,824,474 | B1 | | 11/2004 | Thill | |
| 6,855,068 | B2 | | 2/2005 | Antonious | |
| 6,890,267 | B2 | | 5/2005 | Mahaffey et al. | |
| D509,869 | S | | 9/2005 | Mahaffey | |
| 7,163,468 | B2 | * | 1/2007 | Gibbs et al. | 473/329 |
| 7,390,266 | B2 | | 6/2008 | Gwon | |
| 7,568,985 | B2 | | 8/2009 | Beach et al. | |
| D608,850 | S | | 1/2010 | Oldknow | |
| D609,296 | S | | 2/2010 | Oldknow | |
| D609,297 | S | | 2/2010 | Oldknow | |
| D609,764 | S | | 2/2010 | Oldknow | |
| 7,713,138 | B2 | | 5/2010 | Sato et al. | |
| 8,162,775 | B2 | * | 4/2012 | Tavares et al. | 473/327 |
| 8,678,946 | B2 | * | 3/2014 | Boyd et al. | 473/327 |
| 2001/0027139 | A1 | | 10/2001 | Saso | |
| 2002/0077194 | A1 | | 6/2002 | Carr et al. | |
| 2002/0077195 | A1 | | 6/2002 | Carr et al. | |
| 2003/0087710 | A1 | | 5/2003 | Sheets et al. | |
| 2003/0220154 | A1 | | 11/2003 | Anelli | |
| 2003/0232659 | A1 | | 12/2003 | Mahaffey et al. | |
| 2003/0236131 | A1 | | 12/2003 | Burrows | |
| 2004/0018891 | A1 | | 1/2004 | Antonious | |
| 2004/0138002 | A1 | | 7/2004 | Murray | |
| 2004/0229713 | A1 | | 11/2004 | Helmstetter et al. | |
| 2005/0009622 | A1 | | 1/2005 | Antonious | |
| 2005/0032584 | A1 | | 2/2005 | Van Nimwegen | |
| 2005/0049073 | A1 | | 3/2005 | Herber | |
| 2005/0153798 | A1 | | 7/2005 | Rigoli | |
| 2005/0153799 | A1 | | 7/2005 | Rigoli | |
| 2006/0014588 | A1 | | 1/2006 | Page | |
| 2007/0149310 | A1 | | 6/2007 | Bennett et al. | |
| 2008/0188320 | A1 | | 8/2008 | Kamatari | |
| 2009/0124410 | A1 | | 5/2009 | Rife | |
| 2009/0149276 | A1 | | 6/2009 | Golden et al. | |
| 2009/0203465 | A1 | | 8/2009 | Stites et al. | |
| 2009/0286618 | A1 | | 11/2009 | Beach et al. | |
| 2010/0311517 | A1 | | 12/2010 | Tavares et al. | |
| 2012/0149494 | A1 | * | 6/2012 | Takahashi et al. | 473/345 |

* cited by examiner

GOLF CLUB ASSEMBLY AND GOLF CLUB WITH AERODYNAMIC FEATURES

FIELD

Aspects of this invention relate generally to golf clubs and golf club heads, and, in particular, to a golf club and golf club head with aerodynamic features.

BACKGROUND

The distance a golf ball travels when struck by a golf club is determined in large part by club head speed at the point of impact with the golf ball. Club head speed in turn can be affected by the wind resistance or drag associated with the club head, especially given the large club head sizes of typical modern drivers. The club head of a driver, fairway wood, or metal wood in particular experiences significant aerodynamic drag during its swing path. The drag experienced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surface of the club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the greater the pressure drag.

One way to reduce or minimize the size of the low pressure separation region is by providing a streamlined form that allows laminar flow to be maintained for as long as possible, thereby delaying or eliminating the separation of the laminar air stream from the club surface.

Reducing the drag of the club head not only at the point of impact, but also during the course of the entire downswing prior to the point of impact, would result in improved club head speed and increased distance of travel of the golf ball. When analyzing the swing of golfers, it has been noted that the heel/hosel region of the club head leads the swing during a significant portion of the downswing and that the ball striking face only leads the swing at (or immediately before) the point of impact with the golf ball. The phrase "leading the swing" is meant to describe that portion of the club head that faces the direction of swing trajectory. For purposes of discussion, the golf club and golf club head are considered to be at a 0° orientation when the ball striking face is leading the swing, i.e. at the point of impact. It has been noted that during a downswing, the golf club may be rotated by about 90° or more around the longitudinal axis of its shaft during the 90° of downswing prior to the point of impact with the golf ball.

During this final 90° portion of the downswing, the club head may be accelerated to approximately 65 miles per hour (mph) to over 100 mph, and in the case of some professional golfers, to as high as 140 mph. Further, as the speed of the club head increases, typically so does the drag acting on the club head. Thus, during this final 90° portion of the downswing, as the club head travels at speeds upwards of 100 mph, the drag force acting on the club head could significantly retard any further acceleration of the club head.

Club heads that have been designed to reduce the drag of the head at the point of impact, or from the point of view of the club face leading the swing, may not function well to reduce the drag during other phases of the swing cycle, such as when the heel/hosel region of the club head is leading the downswing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club head with improved aerodynamic performance. In accordance with a first aspect, a golf club head includes one or more drag reducing structures on the body member. The drag-reduction structures are expected to reduce drag for the body member during a golf swing from an end of a backswing through a downswing.

In accordance with further aspects, a golf club includes a shaft and a club head secured to a distal end of the shaft. The club head has a body member including a front body member having a ball striking face, and an aft body member extending rearwardly from the front body member and defining a trailing edge. A rough textured surface region may be provided on a sole of the club head. The rough textured surface region may have a surface roughness of greater than or equal to 1.00 μm.

A channel may extend, at least partially, along and adjacent to the trailing edge of the aft body member. The channel may have a maximum depth less than or equal to 6 mm and a maximum width ranging from 10 mm to 20 mm.

A recess may be formed in a sole of the club head. The recess may extend from a mid-region to a toe of the club head, wherein the mid-region of the club head may extend over the middle 40% of a length of the club head.

A crown may have an upper, forward surface and a stepped-down region, wherein the upper, forward surface transitions to the stepped-down region at a transition feature extending from the hosel region at an angle of from 25 degrees to 50 degrees from a front plane of the club head.

According to certain other aspects, a golf club head for a driver may include a body member having a front body member with a ball striking face and an aft body member extending rearwardly from the front body member to a trailing edge. The body member may have a height-to-volume ratio less than or equal to 0.120, and a breadth-to-volume ratio greater than or equal to 0.260.

According to certain additional aspects, the body member may have a height-to-length ratio of less than or equal to 0.50, and/or the body member may have a breadth-to-length ratio of greater than or equal to 0.97. The body member may have a height of less than or equal to 53 mm and a breadth of greater than or equal to 119 mm.

The body member may have a volume or of greater than equal to 420 cc. Alternatively, the body member may have a volume or of greater than equal to 445 cc.

Further, the club head may have a moment-of-inertia around the vertical z-axis through the center of gravity that is greater than or equal to 3100 g-cm$^2$ and a moment-of-inertia around the horizontal x-axis through the center of gravity that is greater than or equal to 5250 g-cm$^2$.

The body member may be a square-head type or a round-head type.

By providing a golf club head with one or more of the drag-reduction structures disclosed herein, it is expected that the total drag of the golf club head during a player's downswing can be reduced. This is highly advantageous since the reduced drag will lead to increased club head speed and, therefore, increased distance of travel of the golf ball after being struck by the club head.

These and additional features and advantages disclosed here will be further understood from the following detailed disclosure of certain embodiments.

Figure 1:
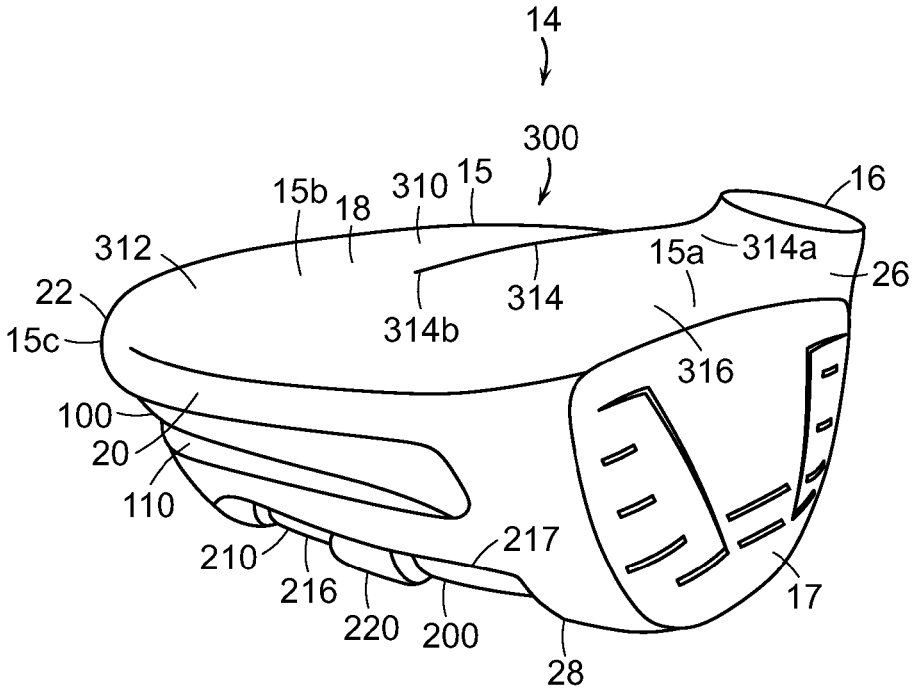
FIG. 1 is a perspective view of a golf club head according to illustrative aspects.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

Figure 2:
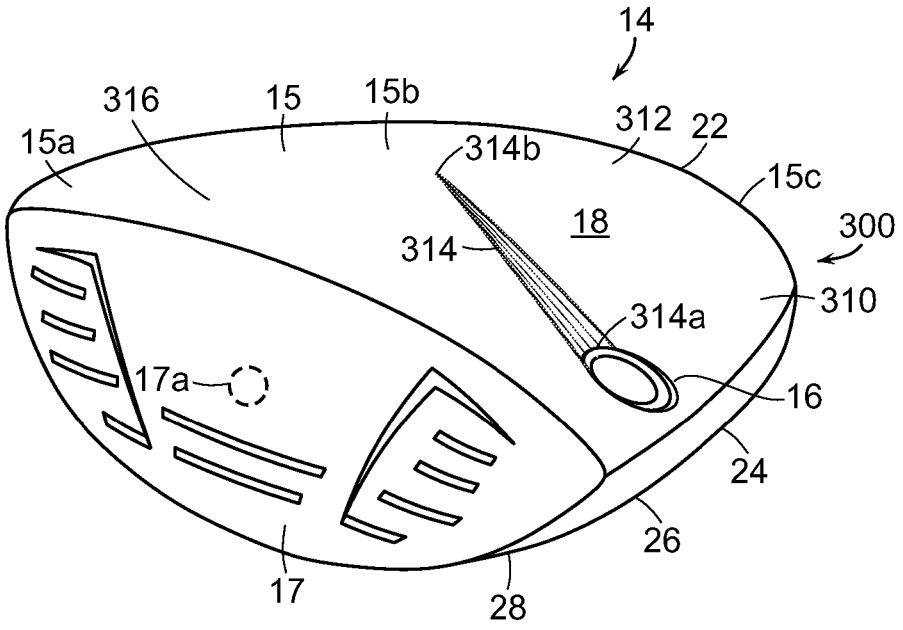
FIG. 2 is another perspective view of the club head of FIG. 1.
Figure 3:
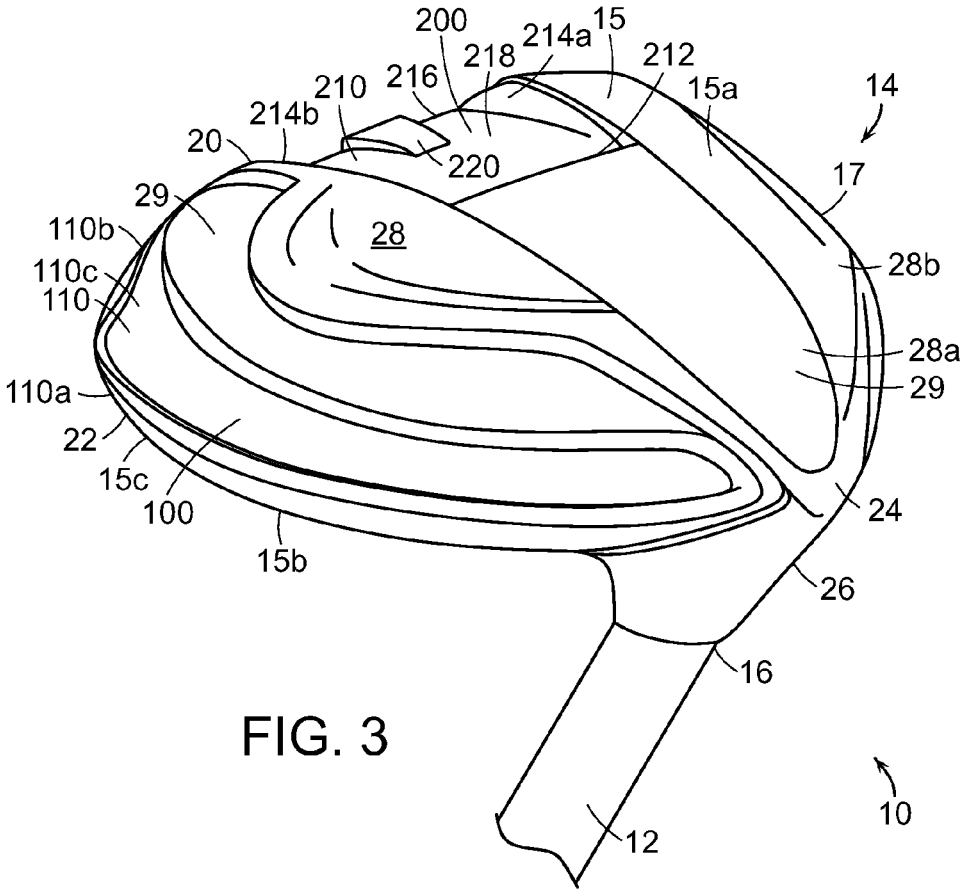
FIG. 3 is another perspective view of a club head according to certain aspects, as shown attached to a golf club shaft to form a golf club according to a disclosed aspect.

According to several aspects, illustrative embodiments of golf club heads 14 are shown in FIGS. 1-4. Golf club head 14 may be attached to a shaft 12, as shown in FIG. 3, to form a golf club 10. Golf club head 14 may be a driver, as shown. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional mariners known and used in the art (e.g., via adhesives or cements at a hosel element, via fusing techniques (e.g., welding, brazing, soldering, etc.), via threads or other mechanical connectors (including releasable and adjustable mechanisms), via friction fits, via retaining element structures, etc.). A grip or other handle element (not shown) may be positioned on the shaft 12 to provide a golfer with a slip resistant surface with which to grasp the golf club shaft 12.

In the example structures of FIGS. 1-4, each of the club heads 14 includes a body member 15 to which the shaft 12 is attached at a hosel or socket 16 configured for receiving the shaft 12 in known fashion. The body member 15 includes a plurality of portions, regions, or surfaces. The body member 15 includes a ball striking face 17, a crown 18, a toe 20, a back 22, a heel 24, a hosel region 26 and a sole 28. Alternatively, for purposes of describing the club head 14, the body member 15 may be described as having a front body member 15*a* and an aft body member 15*b*. Front body member 15*a* includes the ball striking face 17 and those portions of the crown 18, toe 20, sole 28 and hosel region 26 that lie forward of the longitudinal axis of the shaft 12 (when the club head is in the 60 degree lie angle position). Further, the front body member 15*a* generally includes the socket 16. Aft body member 15*b* includes the remaining portions of the club head 14.

Referring to FIG. 2, the ball striking face 17 may be essentially flat or it may have a slight curvature or bow (also known as "bulge"). Although the golf ball may contact the ball striking face 17 at any spot on the face, the desired-point-of-contact 17*a* of the ball striking face 17 with the golf ball is typically approximately centered within the ball striking face 17.

Figure 5B:
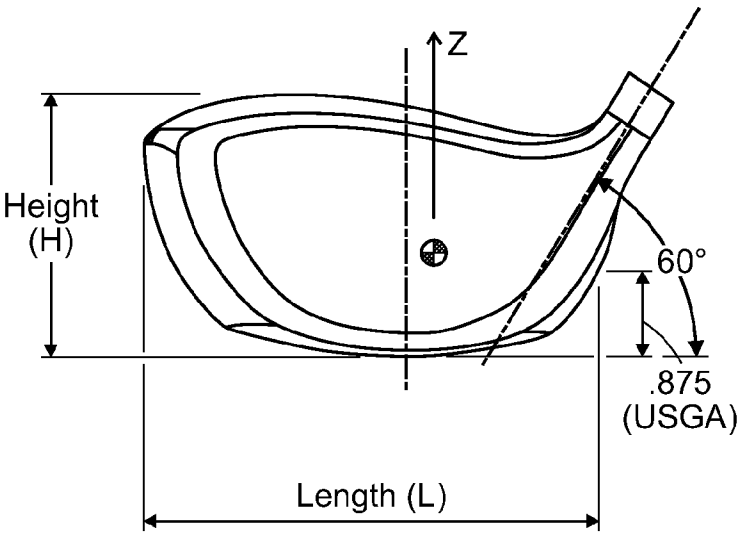
FIGS. 5A and 5B are schematics of a club head (top plan view and front elevation view, respectively) illustrating certain club head parameters.
Figure 5A:
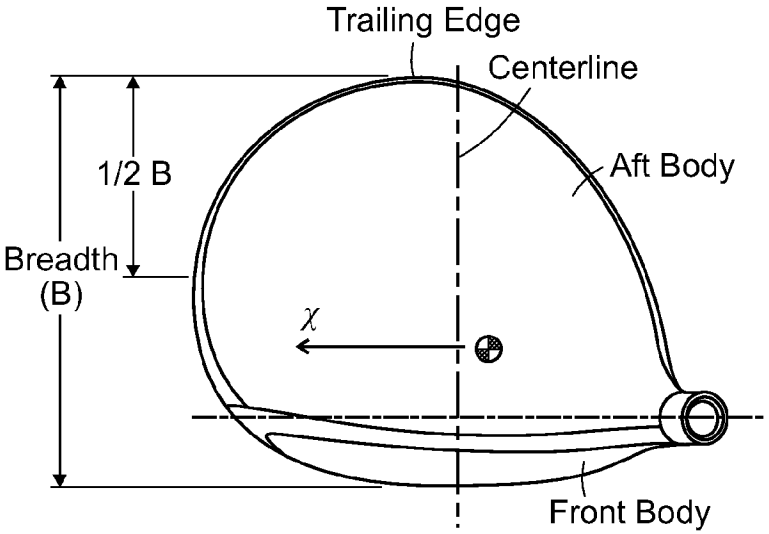

For purposes of this disclosure, and referring to FIGS. 5A and 5B, with a club head positioned at a 60 degree lie angle as defined by the USGA (see USGA, "Procedure for Measuring the Club Head Size of Wood Clubs"), the "centerline" of the club head 14 may be considered to coincide with the indicator on the face squaring gauge when the face squaring gauge reads zero. The length (L) of the club head extends from the outermost point of the toe to the outermost point of the heel, as defined by the above-referenced USGA procedure. The breadth (B) of the club head extends from the outermost point of the face to the outmost point of the back. Similar to the procedure for determining the outermost point of the toe (but now turned 90 degrees), the outermost points of the face and back may be defined as the points of contact between the club head in the USGA 60 degree lie angle position with a vertical plate running parallel to the longitudinal axis of the shaft 12. The height (H) of the club head extends from the uppermost point of the crown to the lowermost point of the sole, as defined by the above-referenced USGA procedure. The terms "above," "below," "front," "rear," "heel-side" and "toe-side" all may refer to views associated with the club head 14 when it is positioned at this USGA 60 degree lie angle.

Referring back to FIGS. 1-4, the crown 18, which is located on the upper side of the club head 14, extends from the ball striking face 17 back toward the back 22 of the golf club head 14. When the club head 14 is viewed from below, the crown 18 cannot be seen.

The sole 28, which is located on the lower or ground side of the club head 14 opposite to the crown 18, extends from the ball striking face 17 back toward the back 22. As with the crown 18, the sole 28 extends across the width of the club head 14, from the heel 24 to the toe 20. When the club head 14 is viewed from above, the sole 28 cannot be seen.

The back 22 is positioned opposite the ball striking face 17, is located between the crown 18 and the sole 28, and extends from the heel 24 to the toe 20. When the club head 14 is viewed from the front, the back 22 cannot be seen.

The heel 24 extends from the ball striking face 17 to the back 22. When the club head 14 is viewed from the toe-side, the heel 24 cannot be seen.

The toe 20 is shown as extending from the ball striking face 17 to the back 22 on the side of the club head 14 opposite to the heel 24. When the club head 14 is viewed from the heel-side, the toe 20 cannot be seen.

The socket 16 for attaching the shaft 12 to the club head 14 is located within the hosel region 26. The hosel region 26 is shown as being located at the intersection of the ball striking face 17, the heel 24, the crown 18 and the sole 28 and may encompass those portions of the heel 24, the crown 18 and the sole 28 that lie adjacent to the socket 16. Generally, the hosel region 26 includes surfaces that provide a transition from the socket 16 to the ball striking face 17, the heel 24, the crown 18 and/or the sole 28.

In the embodiments illustrated in FIGS. 1-4, the body member 15 generally has a traditional round head shape. It is to be appreciated that the phrase "round head" does not refer to a body member 15 that is completely round but, rather, to a body member 15 with an aft body member 15*b* having a generally or substantially rounded profile of a trailing edge 15*c* when viewed from above and/or below. For purposes of this disclosure, the trailing edge 15*c* is defined as the perimeter edge of the aft body member 15*b* that would be contacted by a vertical when the club head is in the 60 degree lie angle position. Further, referring to FIG. 5A, for purposes of this disclosure, the trailing edge is that portion of the vertically-contacted perimeter edge that extends around the back half of the club head. It is further to be appreciated by persons of ordinary skill in the art that the body member may be provided with an aft body member 15*b* having a generally or substantially squared profile of a trailing edge when viewed from above and/or below. The club head 14 would then be described as a "square head." Although not a true square in geometric terms, the body member would be considered substantially square as compared to a more traditional, rounded, club head.

According to certain aspects, the club head 14 may include one or more drag-reducing structures in order to reduce the overall drag on the club head 14 during a user's golf swing from the end of a user's backswing through the downswing. The drag-reducing structures may be configured to provide reduced drag during the entire downswing of a user's golf swing or during a significant portion of the user's downswing, not just at the point of impact.

First it may be noted, that the ball striking face 17 does not lead the swing over entire course of a player's downswing. Only at the point of impact with a golf ball is the ball striking face 17 ideally leading the swing, i.e., the ball striking face 17 is ideally substantially perpendicular to the direction of travel of club head 14 (and the flight of the golf ball) at the point of impact. However, it is known that during the player's backswing and during the player's downswing, the player's hand twist golf club 10 such that yaw is introduced, thereby pivoting ball striking face 17 away from its position at impact. With the orientation of ball striking face 17 at the point of impact considered to be 0°, during the backswing ball striking face twists away from the user toward toe 20 and back 22 to a maximum of 90° (or more) of yaw, at which point heel 24 is the leading edge of club head 14.

Second it may be noted, that aerodynamic boundary layer phenomena acting over the course of the player's downswing may cause a reduction in club speed due to drag. During a player's downswing, the air pressure and the energy in the boundary layer flowing over the surface of the club head tend to increase as the air travels over the length of the club head. The greater the air pressure and energy in the boundary layer, the more likely the boundary layer will separate from the club head 14, thereby creating a low pressure separation zone behind the club head. The larger the separation zone, the greater the drag. Thus, according to certain aspects, drag-reducing structures may be designed to reduce the air pressure and the energy in the boundary layer, thereby allowing the boundary layer to maintain contact with the surface of the club head over a longer distance and thereby reducing the size of the separation zone. Further, according to certain aspects, the drag-reducing structures may be designed to maintain laminar flow over the surface of the club head over the greatest distance possible. A laminar flow results in less drag due to friction over the surface of the club head, and thus, maintaining a laminar air flow over the entire surface of the club head may be the most desirable. However, this is generally not possible. Thus, alternatively, when a laminar flow cannot be completely maintained over the entire surface of the club head 14, it may be desirable in some instances to trigger a transition from a laminar flow to a turbulent flow. Although a turbulent flow has a higher drag over the surface, as compared to a laminar flow, the turbulent boundary layer flow will resist separating from the surface at higher pressures and energy than the laminar flow. By delaying the separation of the (now turbulent) boundary layer flow, from the surface of the club head, the size of the separation zone in the trailing region is reduce and correspondingly drag due to the low-pressure trailing region is reduced.

In general, it is expected that minimizing the size of the separation zone behind the club head 14, i.e., maintaining a boundary layer airflow (whether laminar or turbulent) for as long as possible, should result in the least drag. Further, it is expected that maintaining a boundary layer over the club head as the club head changes orientation during the player's downswing should also result in increase club head speed. Thus, some of the example drag-reducing structures described in more detail below may be provided to maintain laminar and/or turbulent boundary layer airflow over one or more of the surfaces of the club head 14 when the ball striking face 17 is generally leading the swing, i.e., when air flows over the club head 14 from the ball striking face 17 toward the back 22. Additionally, it is expected that some of the example drag-reducing structures described in more detail below may provide various means to maintain laminar and/or turbulent boundary layer airflow over one or more surfaces of the club head 14 when the heel 24 is generally leading the swing, i.e., when air flows over the club head 14 from the heel 24 toward the toe 20. Moreover, it is expected that some of the example drag-reducing structures described in more detail below may provide various means to maintain laminar and/or turbulent boundary layer airflow over one or more surfaces of the club head 14 when the hosel region 26 is generally leading the swing, i.e., when air flows over the club head 14 from the hosel region 26 toward the toe 20 and/or the back 22. Further, it is even expected that some of the example drag-reducing structures described in more detail below may provide various means to trigger the transition from a laminar airflow to a turbulent air flow over one or more of the surfaces of the club head 14, such that the boundary layer may be expected to remain attached to the surface of the club head for a longer distance. The example drag-reducing structures disclosed herein may be incorporated singly or in combination in club head 14 and are applicable to any and all embodiments of the club head 14.

According to certain aspects of the present disclosure, the body member 15 may be generally "flattened" compared to other club heads having similar volumes. In other words, the height (H) of the club head may be less than the height of clubs having similar volumes and profiles. Thus, a "round head" driver having a volume ranging from 420 cc to 470 cc may have a ratio of the club head height-to-volume that ranges from 0.110 to 0.120. By way of non-limiting example, a "round head" type club head having a volume of 445 cc may have a club height of 53 mm, thereby presenting a club head height-to-volume ratio of 0.119. Similarly, a "square head" driver having a volume ranging from 420 cc to 470 cc may have a ratio of the club head height-to-volume that ranges from 0.105 to 0.115. Thus, by way of non-limiting example, a "square head" type club head having a volume of 456 cc may have a club height of 52 mm, thereby presenting a club head height-to-volume ratio of 0.114.

Alternatively, the "flattening" of the club head may be expressed as a ratio of the club head's height (H) to the club head's length (L). Thus, a "round head" type driver having a volume ranging from 420 cc to 470 cc may have a ratio of the club head height-to-length that ranges from 0.44 to 0.50. By way of non-limiting example, for a "round head" type club head having a volume of 445 cc, the club length (L) may be 117 mm and the club height (H) may be 53 mm or less, thereby presenting a club head height-to-length ratio of 0.453. Similarly, a "square head" type driver having a volume ranging from 420 cc to 470 cc may have a ratio of the club head height-to-length that ranges from 0.42 to 0.48. By way of non-limiting example, for a "square head" type club head having a volume of 456 cc, the club length (L) may be 124 mm and the club height (H) may be 53 mm or less, thereby presenting a club head height-to-length ratio of 0.427.

According to aspects of the present disclosure, the body member 15 may be generally "elongated" compared to other club heads having similar volumes. In other words, the breadth (B) of the club head may be greater than the breadth of clubs having similar volumes and profiles. Thus, a driver having a volume ranging from 420 cc to 470 cc may have a ratio of the club head breadth-to-volume that ranges from 0.260 to 0.275. By way of non-limiting example, a club head having a volume of 445 cc may have a club breadth of 119 mm, thereby presenting a club head breadth-to-volume ratio of 0.267.

Alternatively, the "elongation" of the club head may be expressed as a ratio of the club head's breadth (B) to the club head's length (L). Thus, a driver having a volume ranging from 420 cc to 470 cc may have a ratio of the club head breadth-to-length that ranges from 0.97 to 1.02. By way of non-limiting example, for a club head having a volume of 445 cc, the club breadth (B) may be 118 mm and the club length (L) may be 119 mm, thereby presenting a club head breadth-to-length ratio of 0.99.

It is expected that the "flattening" and "elongating" of the club head, relative to club heads having the same volume, will allow for a more streamlined club head with improved moment-of-inertia (MOI) characteristics. Thus, for example, it is expected that the moment-of-inertia (Izz) around a vertical axis associated with the club head's center-of-gravity may be greater than 3100 g-cm$^2$, greater than 3200 g-cm$^2$, or even greater than 3300 g-cm$^2$ for square-head type club heads. Further, it is expected that the moment-of-inertia (Ixx) around a horizontal axis associated with the club head's center-of-gravity may be greater than 5250 g-cm$^2$, greater than 5350 g-cm$^2$, or even greater than 5450 g-cm$^2$ for square-head type club heads. The vertical (z) axis and the horizontal (x) axis are defined with the club head in the 60° lie angle position (see FIGS. 5A and 5B).

Figure 4:
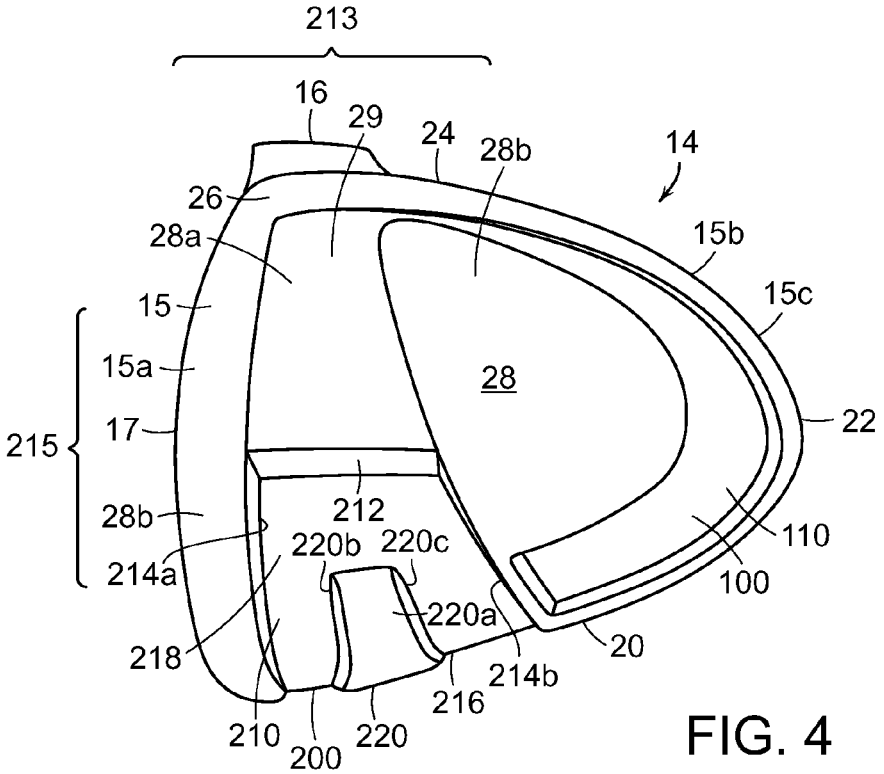
FIG. 4 is a bottom plan view of a club head of according to other aspects.

According to some aspects and referring to FIGS. 1-4, and particularly to FIGS. 1, 3, and 4, a drag-reducing structure 100 may be provided on a body member 15. According to certain aspects, the drag-reducing structure 100 may be formed as a relatively wide, shallow groove or channel 110 that generally follows the profile of the trailing edge 15*c* of the aft body member 15*b*. In some aspects, the channel 110 essentially separates or decouples the curvature of the surface of the sole 28 from the curvature of the surface of the crown 18 in the vicinity of the trailing edge 15*c* of the aft body member 15*b*. In other words, the curvature characteristics of the surface of the sole 28 in the vicinity of the trailing edge 15*c* may be developed without consideration of the curvature characteristics being developed for the surface of the crown 18 in the vicinity of the trailing edge 15*c*. This offers the club head designer greater flexibility when shaping the surfaces of the crown 18 and/or sole 28 and incorporating or developing aerodynamic features.

Thus, for example, as shown in the embodiments of FIGS. 3 and 4, drag-reducing structures 100 may be provided as channels 110 that lie adjacent to a trailing edge 15*c*. The channel 110 may be provided with an outboard sidewall 110*a*, an inboard sidewall 110*b* and a floor or bottom 110*c*. At least a portion of the channel 110 may be located on the sole-side of the aft body member 15*b*, i.e., at least a portion of the channel 110 is located to the sole side of the trailing edge 15*c*. In other words, at least a portion of the channel 110 may be viewed from below. Further, the channel 110 may be positioned just slightly inboard of the trailing edge 15*c*. By way of non-limiting examples, the outboard side wall 110*a* of the channel 110 may be positioned from approximately 2 mm to approximately 10 mm, or even from approximately 2 mm to approximately 5 mm, inboard of the trailing edge 15*c*.

Figure 6:
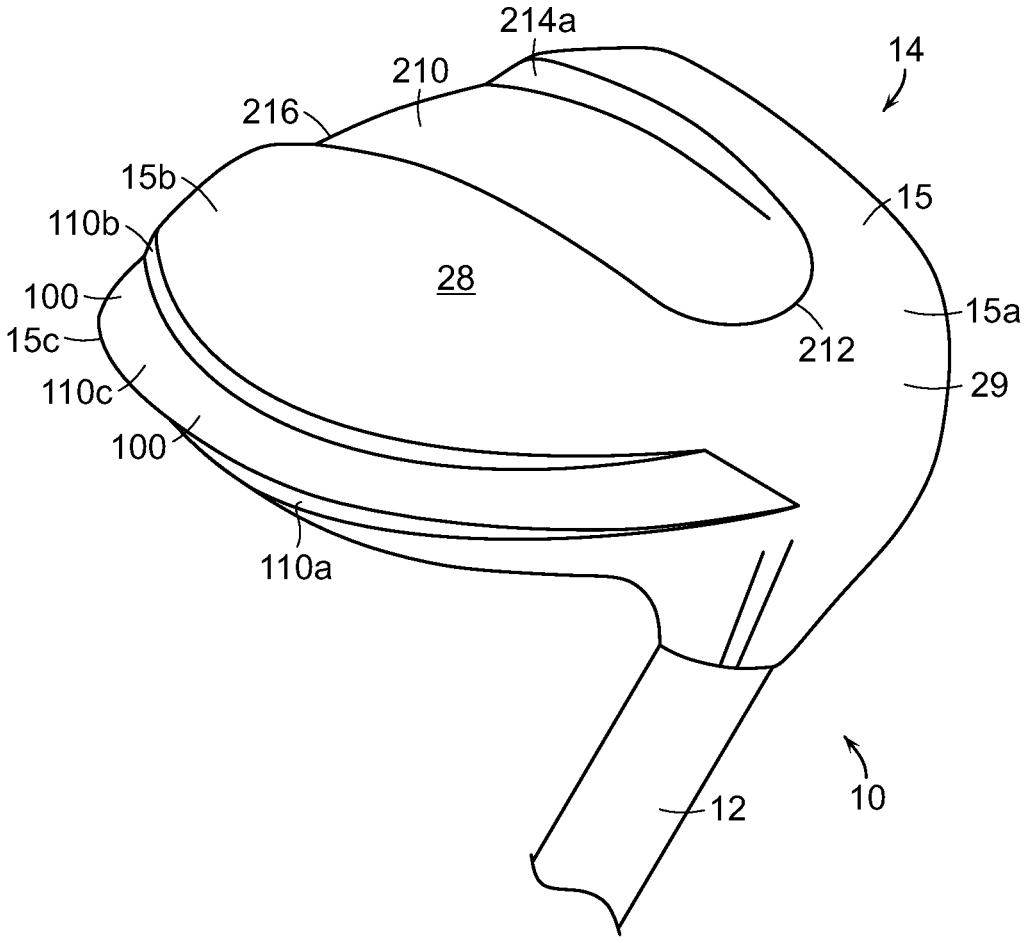
FIG. 6 is a perspective view of a club head, shown attached to a golf club shaft to form a golf club, according to certain illustrative aspects.

Alternatively, as shown in FIG. 6, one edge of the channel 110 may be coincident with the trailing edge 15*c*, such that the floor or bottom 110*c* of the channel 110 contacts the trailing edge 15*c* and there is no outboard sidewall. Optionally, as also shown in FIG. 6, a portion of the outboard edge of the channel 110 may be coincident with at least a portion of the trailing edge 15*c*, while the remainder of the outboard edge of the channel 110 may be inboard of the trailing edge 15*c*. Even further, optionally, as shown in FIGS. 7A and 7B, at least a portion of the outboard sidewall 110*a* may be coincident with at least a portion of the trailing edge 15*c*.

Figure 7A:
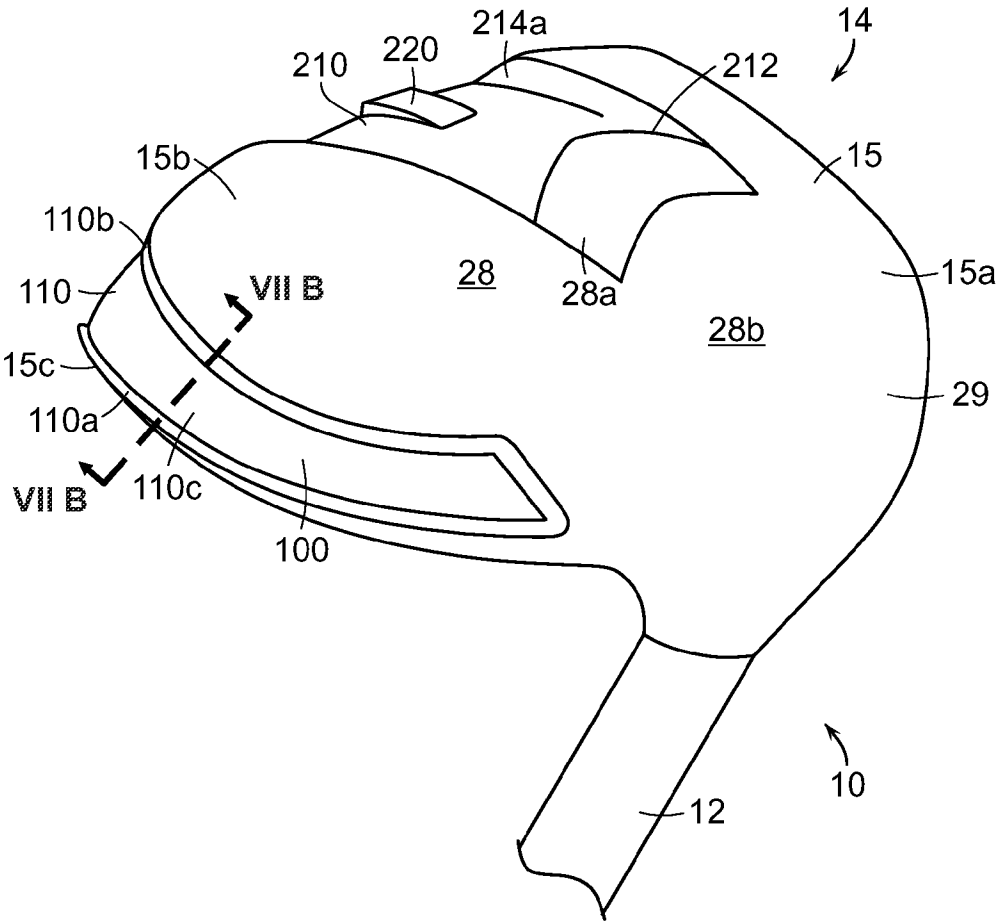
FIG. 7A is a perspective view of a club head, shown attached to a golf club shaft to form a golf club, according to other illustrative aspects.

According to certain aspects, as shown in FIG. 7A the channel 110 need not extend along the entire extent of the trailing edge 15*c*. Alternatively, one or both ends of the channel 110 may optionally extend beyond the extent of the trailing edge 15*c*.

Figure 7B:
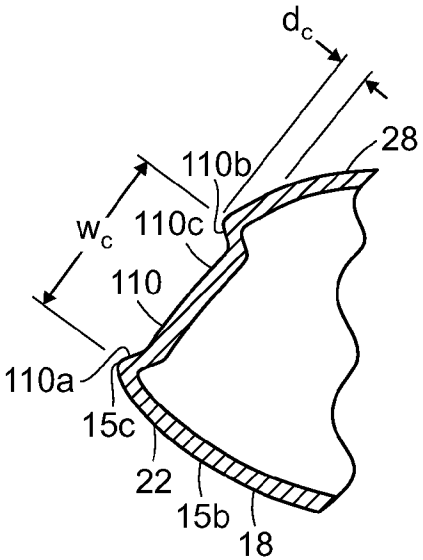
FIG. 7B is a cross-sectional detail of the club head of FIG. 7A, taken at section VII A-VII A.

Even further, according to other aspects, the channel 110 may be continuous or discontinuous; the depth ($d_C$) of the channel may vary, and/or the width ($w_C$) of the channel may vary (see FIG. 7B). Thus, by way of non-limiting example, one or both of the depth ($d_C$) and width ($w_C$) of the channel 110 may gradually decrease at one or both of the ends of the channel 110, such that the channel 110 may smoothly merge into the surrounding surfaces of the club head 14 (see FIG. 6). Thus, for example as shown in FIG. 4, the channel 110 may include an end that tapers as it approaches the hosel region 26.

The maximum width ($w_C$) of the channel 110 may range from approximately 5 mm to approximately 30 mm, from approximately 10 mm to approximately 25 mm, from approximately 10 mm to approximately 20 mm, or even from approximately 5 mm to approximately 15 mm. The maximum depth ($d_C$) of the channel 110 may range from approximately 2 mm to approximately 10 mm, from approximately 2 mm to approximately 8 mm, from approximately 2 mm to approximately 6 mm, or even from approximately 2 mm to approximately 4 mm. Thus, the maximum depth ($d_C$) of the channel 110 may be less than or equal to 10 mm, or to 8 mm, to 6 mm, to 4 mm, or even to 2 mm.

In some aspects, the channel 110 may function as a Kammback feature. Generally, Kammback features are designed to take into account that a laminar flow, which could be maintained with a very long, gradually tapering, downstream end (relative to the direction of air flowing over the club head) of an aerodynamically-shaped body, cannot be maintained with a shorter, tapered, downstream end. When a downstream tapered end would be too short to maintain a laminar flow, drag due to turbulence may start to become significant after the downstream end of a club head's cross-sectional area is reduced to approximately fifty percent of the club head's maximum cross section. This drag may be mitigated by shearing off or removing the too-short tapered downstream end of the club head, rather than maintaining the too-short tapered end. It is this relatively abrupt cut off of the downstream tapered end that is referred to as the Kammback feature.

During a significant portion of the golfer's downswing, as discussed above, the heel 24 and/or the hosel region 26 lead the swing. During these portions of the downswing, either the toe 20, portion of the toe 20, the intersection of the toe 20 with the back 22, and/or portions of the back 22 form the downstream end of the club head 14 (relative to the direction of air flowing over the club head). Thus, the Kammback feature, when positioned along the toe, at the intersection of the toe 20 with the back 22, and/or along the back 22 of the club head 14, may be expected to reduce turbulent flow, and therefore reduce drag due to turbulence, during these portions of the downswing.

Further, during the last approximately 20° of the golfer's downswing prior to impact with the golf ball, as the ball striking face 17 begins to lead the swing, the back 22 of the club head 14 becomes aligned with the downstream direction of the airflow. Thus, the Kammback feature, when positioned along the back 22 of club head 14, is expected to reduce turbulent flow, and therefore reduce drag due to turbulence, most significantly during the last approximately 20° of the golfer's downswing.

According to certain aspects and referring for example to the embodiments of FIG. 3, the sole 28 may be provided with a wide, shallow step 29 located just inboard of the channel 110. This step 29 may provide a transition from the main surface of the sole 28 to the channel 110.

According to even other aspects of the disclosure and referring, for example, to FIGS. 1, 3 and 4, a drag-reducing structure 200 may be provided as a recess 210 formed in the sole 28. As air flows over the sole 28 of the club head 14 generally from the heel 24 to the toe 20, the pressure and energy in the boundary layer airflow increases. The recess 210 may function as a diffuser, such that air flowing over the sole 28 of the club head 14 from the heel 24 toward the toe 20 will be slowed down. It is expected that this diffusing action will assist in reducing the pressure and the energy of the air flowing over the surface and thereby assist in maintaining a boundary layer airflow over a greater distance, i.e., delay the separation of the boundary layer airflow from the surface of the club head.

Referring to FIGS. 3 and 4, in these example embodiments, the recess 210 may generally be located in a forward region of the club head 14. When the club head is viewed from the heel-side, it can be seen that the forward region of the club head, by virtue of its larger cross-sectional area, will displace more air than a rear region of the club head. Thus, it is expected that the pressure build-up of the air flowing over the sole 28 in the forward region will be greater than the pressure build-up of the air flowing over the sole 28 in the rear region of the club head. By placing the recess 210 in the forward region of the club head 14, the diffusing effects of the recess 210 may have a greater effect. The forward region of the club head 14 may be considered to be the forward 20% of the breadth (B) of the club head, the forward 30% of the breadth (B) of the club head, the forward 40% of the breadth (B) of the club head, the forward 50% of the breadth (B) of the club head, or even the forward 60% of the breadth (B) of the club head. Thus, as best shown in FIG. 4, the recess 210 may be located in the forward 60% of the breadth (B) of the club head 14, with the majority of the recess 210 being located in the forward 50% of the breadth (B) of the club head.

Further, in the illustrated embodiments of FIGS. 1, 3 and 4, the recess 210 is shown as being substantially trapezoidally-shaped, having a leading edge 212, sidewalls 214*a*, 214*b*, an exit region 216, a trailing edge 217 and a floor 218. Referring to the embodiment of FIG. 4, the leading edge 212 may be located in a mid-region 215 with respect to the heel-to-toe length of the club (L). The leading edge 212 of the recess 210 is shown as generally extending in a front-to-rear direction. Further, in this particular embodiment, the leading edge 212 is formed as a relatively straight edge. Even further, in this particular embodiment, the leading edge 212 is formed with a relatively smooth, obtusely-angled, surface that provides a gradual, sloped transition between the surface of the sole 28 and the floor 218 of the recess 210. The leading edge 212 of the recess 210 need not be formed as a relative straight edge. Thus, by way of non-limiting example, the leading edge 212 may be curved (see e.g., FIGS. 6 and 7A).

By placing the leading edge 212 of the recess 210 in the heel-to-toe mid-region 215 (see FIG. 4) of the club head 14, the diffusing effects of the recess 210 may prevent turbulent flow from developing in that area of the club head 14 that would be most susceptible to the development of turbulent flow (i.e., the higher pressure region). The heel-to-toe mid region 215 of the club head 14 may be the middle 60% of the length (L) of the club head, the middle 50% of the club head, the middle 40% of the club head, or even limited to just the middle 30% of the club head. Thus, for example, the leading edge 212 of the recess 210 may be located approximately 20% to 35% of the length (L) of the club head from the heel 24, approximately 35% to 45% of the length (L) of the club head from the heel 24, approximately 45% to 55% of the length (L) of the club head from the heel 24, approximately 55% to 65% of the length (L) of the club head from the heel 24, or even approximately 65% to 80% of the length (L) of the club head from the heel 24. As shown in FIG. 4, the leading edge 212 of the recess 210 is located approximately 50% of the length (L) of the club head from the heel 24. As shown in FIG. 6, the leading edge 212 of the recess 210 is located approximately 25% of the length (L) of the club head from the heel 24.

The first and second sidewalls 214*a*, 214*b* are shown in FIG. 4 as extending, with a slight curvature, from the leading edge 212 of the recess 210 toward the toe 20. Further, as the sidewalls 214*a*, 214*b* extend toward the toe 20 they depart from one another, such that the width of the recess 210 increases. Additionally, in the example embodiment as shown in FIG. 3, these first and second sidewalls may increase in depth as they extend away from the leading edge 212. Thus, the recess 210 may be provided with a cross-sectional area ($A_R$) that generally increases as the recess 210 extends toward the toe 20. In certain embodiments, the cross-sectional area may increase by 50% or more.

The recess 210 may have a maximum depth that ranges from approximately 2 mm to approximately 10 mm. Thus, for example, the recess 210 may be a relatively shallow recess, having a maximum depth of less than or equal to 6 mm, to 4 mm, or even less than or equal to 3 mm. Additionally, the recess 210 may have a maximum width that ranges from approximately 20 mm to approximately 60 mm. Thus, for example, the recess 210 may be relatively narrow, having a maximum width of less than or equal to 40 mm, to 30 mm, or even less than or equal to 25 mm.

The exit region 216 of the recess 210 may be located at the transition of the sole 28 to the toe 20. As shown in the example embodiments of FIGS. 1 and 4, the exit region 216 may be configured to allow the air flowing along the surface of the sole 28 to exit the club head (i.e., to depart from the surface of the club head) without encountering any significant impedance or obstacles. Referring to FIG. 1, it is shown that the recess 210 may include a trailing edge 217 and that this trailing edge may be located beyond the path of the airflow coming off of the sole 28. In other words, the trailing edge 217 of the recess 210 may be provided on a surface of the toe 20 such that the trailing edge lies beyond the point where the airflow leaves the surface of the club head 14. Further, the trailing edge 217 may also be provided with a relatively smooth, obtusely-angled, surface that provides a gradual, sloped transition between the surface of the toe 20 and the floor 218 of the recess 210.

Optionally, the recess 210 may include a downstream vane or wedge feature 220 that rises up from the floor 218. As shown in FIG. 4, the wedge feature 220 may include an upper surface 220*a* and sidewalls 220*b*, 220*c*. The upper surface 220 may be formed as a generally smooth extension of the floor 218 of the recess 210 that increases in width as the wedge feature extends toward the toe 220. The sidewalls 220*b*, 220*c* may increase in depth as the wedge feature 220 extends toward the toe 20. In the embodiments shown in FIGS. 1, 3 and 4, the height of the wedge feature 220 is always less than the depth of the recess 210. As shown in FIG. 6, the recess 210 need not include a downstream wedge feature.

According to even other aspects, and referring, for example, to FIGS. 1 and 2, a drag-reducing structure 300 may be provided as a reduced-height or stepped-down region 310 formed in the crown 18. The crown 18 extends from the ball striking face 17 to the rear 22 and from the heel 24 to the toe 20. Generally, the crown 18 is provided with a smooth, slightly-convex, complexly-curved surface 312. The crown 18 includes an upper crown surface 316 that is located adjacent the ball striking face 17. The stepped-down region 310 is located adjacent the heel 24. The stepped-down region 310 is stepped down relative to the upper crown surface 316.

As part of the drag-reducing structure 300, the crown 18 includes a transition feature 314 that demarcates the upper crown surface 316 from the stepped-down region 310. As shown in FIG. 2, the transition feature 314 may be a generally elongated feature that extends from a near end 314*a*, located in the vicinity of the socket 16, toward a far end 314*a*. Further, the transition feature 314 may be angled toward the rear 22 and away from the ball striking face 17 as it extends away from the socket 16. In the embodiment of FIG. 1, the transition feature 314 is angled at approximately 30° from the plane of the longitudinal axis of the shaft 12 when the club head 14 is oriented at the USGA 60° lie angle position. This plane may be referred to as the "front plane" of the club head. According to other aspects, the transition feature 314 may be angled from approximately 10° to approximately 70° from the plane of the longitudinal axis of the shaft 12 when the club head 14 is oriented at the USGA 60° lie angle position. More preferred orientations of the transition feature 314 may be at an angle from approximately 20° to approximately 60°, at an angle from approximately 25° to approximately 50°, or even at an angle from approximately 30° to approximately 45° from the plane of the longitudinal axis of the shaft 12 when the club head 14 is oriented at the USGA 60° lie angle position The transition from the upper, more forward, crown surface 316 to the stepped-down region 310 may be provided as a gradual, smooth change in slope from to the upper surface 316 to the stepped-down region 310, wherein the depth of the transition feature 314 is less than or equal to the width of the transition feature 314. Alternatively, the transition from the upper surface 316 to the stepped-down region 310 may be provided as a more abrupt change in slope from the upper surface 316 to the stepped-down region 310, wherein the depth of the transition feature 314 is greater than the width of the transition feature 314. Further, the transition feature 314 may decrease in depth and/or width as the transition feature extends away from the socket 16. The maximum depth of the transition feature 314, i.e., the maximum change in height from the upper surface 316 to the stepped-down region 310) may range from approximately 5 mm to approximately 10 mm. The maximum width of the transition feature may range from approximately 5 to approximately 20 mm.

In certain embodiments, the transition feature may smoothly merge into the surface of the crown 18 at its far end 314*b*. Thus, as shown in the figures, beyond the far end 314*b* of the transition feature 314, the crown 18 may be formed without any noticeable transition from an upper surface 316 to a stepped-down region 310. In other embodiments, the transition feature 314 may extend all the way across the crown 18 to an edge of the club head.

The upper crown surface 316 provides a smooth surface for air encountering the ball striking face 17 to flow up and over. The stepped-down region 310 provides a smooth surface on the crown 18 for air encountering the heel 24 to flow up and over. The transition feature 314 allows the upper crown surface 316 to be at a different, greater height than the stepped-down region 310. Thus, for example, the height of the front body portion 15*a* of the club head 14 may be designed quasi-independently from the height of the aft body portion 15*b* of the club head 14. This may allow for a greater height of the ball striking face 17, while allowing a cross-sectional area of the heel 24 to be reduced to provide greater aerodynamic streamlining for air flowing over the heel 24.

According to even other aspects of the disclosure, the sole 28 of the club head 14 may include a relatively flat region 29 in the forward portion of the club head in the vicinity of the hosel region 26 and/or the heel 24. This may best be illustrated in FIGS. 3, 4, 6 and 7A. The relatively flat region 29 of the sole 28 may allow for easier adjustment of the loft angle and/or lie angle of the club head 14.

According to other aspects, the sole 28 may further include a variety of different surface finishes. Specifically, portions of the surface of the sole 28 may have a very smooth texture, while other portions of the surface of the sole 28 may have a rough texture. It is expected that drag reduction could be achieved by selective application of a rough finish where it is desirable to trigger a transition from a laminar airflow to a turbulent airflow. As discussed above, laminar airflows produce lower surface drag than turbulent airflows, but laminar flows tend to separate from the surface sooner than turbulent airflows. Typically, the earlier separation of the laminar airflow boundary layer from the surface of the club head 14 results in larger separation zones, thus increasing drag due to these larger low-pressure separation zones. It is expected that when the formation of a separation zone is inevitable, in some instances it may be desirable to trigger a transition from laminar airflows to turbulent airflows, to thereby delay separation of the boundary layer from the surface and reduce the size of the separation zone.

Referring to the embodiments of FIGS. 3 and 4, regions 28*a* of the soles 28 may be provided with a relatively rough surface texture. According to certain aspects, the relatively flat region 29 of the sole may be provided with a relatively rough surface region 28*a*. The relatively rough surface region 28*a* may have an average roughness Ra ranging from approximately 1.00 μm to approximately 12.5 μm, or even greater. Optionally, the relatively rough surface regions 28*a* may have an average roughness Ra ranging from approximately 1.00 μm to approximately 5.0 μm, or even from approximately 1.00 μm to approximately 2.5 μm. This relatively rough surface texture may be formed, by way of non-limiting example, as a blasted finish. Blasting results in the removal of very small pieces of material from the surface. The material that forms the surface to be blasted, the choice of blast media and the blast intensity (i.e., the energy of the stream of blast media) control the resultant surface finish. Bead and/or shot-blasted surfaces may result in non-directional, relatively uniformly textured surfaces. Blasted surfaces may thus be provided with a matt finish and a low reflectivity.

Alternatively, the relatively rough surface texture may be formed by peening. Peening also requires impacting the surface with a blasting media. However, with peening, the blasting media is formed of rounded beads and their impact upon the surface does not result in the removal of any material. Rather, the impact of the peening media causes dents or dimples to be formed in the material as the material is pushed aside. As even another alternative, for example, the relatively rough surface texture may be formed by etching, such as acid etching. As a further alternative, the relatively rough surface texture may be formed by mechanical abrasion. As an even further alternative, the relatively rough surface texture may be formed by a coating.

The relatively rough textured region 28*a* may be located on the forward part of the sole 28. For example, in the embodiment of FIG. 3, the relatively rough textured region 28*a* extends from the hosel region 26/heel 24 over to the drag-reducing structure 200 provided by the recess 210. In the example embodiment of FIG. 4, the relatively rough textured region 28*a* is also located in the forward half of the sole 28, extending from the hosel region 26/heel 24 to the recess 210. In both of these example embodiments, the width of the region 28*a* is approximately aligned with the width of the recess 210. In the example embodiment of FIG. 7A, a relatively rough textured region 28*a* is located adjacent the leading edge 212 of the recess 210. In this example embodiment, the region 28*a* does not extend over to the hosel region 26 and/or to the heel 24.

Optionally, also referring to the embodiments of FIGS. 3 and 4, regions 28*b* of the soles 28 may be provided with a relatively smooth, polished texture. The relatively smooth surface regions 28*b* may have an average roughness Ra ranging from approximately 0.90 μm to approximately 0.012 μm. As one non-limiting example, the relatively smooth surface texture may be formed as a highly polished finish. As shown in the example embodiments of FIGS. 3 and 4, relatively smooth textured regions 28*b* extend across the sole 28 (from the hosel region 26/heel 24 to the toe 20) in the forward portion of the sole 28, on either side of the relatively rough textured region 28*a* and on either side of the recess 210.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a driver, the club head comprising:
a body member including:
a front body member having a ball striking face, and
an aft body member extending rearwardly from the front body member and defining a trailing edge;
a rough textured surface region provided on a sole, wherein the rough textured surface region has a surface roughness of greater than or equal to 1.00 μm and the rough textured surface region is at least partially located in a forward half of the sole; and
a crown having an upper, forward surface and a stepped-down region, wherein the upper, forward surface transitions to the stepped-down region at a transition feature extending from the hosel region at an angle of from 25 degrees to 50 degrees from a front plane of the club head, as viewed from above.

2. The golf club head of claim 1, further including a channel extending, at least partially, along and adjacent to the trailing edge of the aft body member, the channel having a maximum depth less than or equal to 6 mm and a maximum width ranging from 10 mm to 20 mm, wherein the channel is located to the sole side of the trailing edge.

3. The golf club head of claim 1, further including a recess formed in a sole of the club head, the recess extending from a mid-region to a toe of the club head, wherein the mid-region of the club head extends over the middle 40% of a length of the club head.

4. The golf club head of claim 1, wherein the channel has a maximum width of greater than or equal to 15 mm.

5. The golf club head of claim 1, wherein the channel has a maximum depth of less than or equal to 4 mm.

6. A golf club head for a driver, the club head comprising:
a body member including a front body member having a ball striking face and an aft body member extending rearwardly from the front body member to a trailing edge;
the body member having a height-to-volume ratio less than or equal to 0.120;
the body member having a breadth-to-volume ratio greater than or equal to 0.260; and
a crown having an upper, forward surface and a stepped-down region, wherein the upper, forward surface transitions to the stepped-down region at a transition feature extending from the hosel region at an angle of from 25 degrees to 50 degrees from a front plane of the club head, as viewed from above.

7. The golf club head of claim 6, wherein the body member has a height-to-length ratio of less than or equal to 0.50.

8. The golf club head of claim 6, wherein the body member has a breadth-to-length ratio of greater than or equal to 0.97.

9. The golf club head of claim 6, wherein the body member has a volume of greater than or equal to 420 cc.

10. The golf club head of claim 6, wherein the body member has a volume of greater than or equal to 445 cc.

11. The golf club head of claim 6, wherein the body member has a height of less than or equal to 53 mm and a breadth of greater than or equal to 119 mm.

12. The golf club head of claim 6, wherein the club head has a moment-of-inertia around the vertical z-axis through the center of gravity that is greater than or equal to 3100 g-cm$^2$ and a moment-of-inertia around the horizontal x-axis through the center of gravity that is greater than or equal to 5250 g-cm$^2$.

13. The golf club head of claim 6, wherein the body member is a square head member.

14. The golf club head of claim 6, wherein the body member is a round head member.

15. A golf club comprising:

a shaft; and a club head secured to a distal end of the shaft, the club head having a body member including:

a front body member having a ball striking face, and an aft body member extending rearwardly from the front body member and defining a trailing edge;

a rough textured surface region provided on a sole, wherein the rough textured surface region has a surface roughness of greater than or equal to 1.00 μm;

a channel extending, at least partially, along and adjacent to the trailing edge of the aft body member, the channel having a maximum depth less than or equal to 6 mm and a maximum width ranging from 10 mm to 20 mm;

a recess formed in a sole of the club head, the recess extending from a mid-region to a toe of the club head, wherein the mid-region of the club head extends over the middle 40% of a length of the club head; and a crown having an upper, forward surface and a stepped-down region, wherein the upper, forward surface transitions to the stepped-down region at a transition feature extending from the hosel region at an angle of from 25 degrees to 50 degrees from a front plane of the club head, as viewed from above.

* * * * *